US008485611B2

(12) United States Patent
Weis et al.

(10) Patent No.: US 8,485,611 B2
(45) Date of Patent: Jul. 16, 2013

(54) CLEANING IMPLEMENT

(75) Inventors: Norbert W. Weis, Weinheim (DE); Ralf G. Juergens, Glen Ellyn, IL (US)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 13/446,991

(22) Filed: Apr. 13, 2012

(65) Prior Publication Data

US 2012/0200142 A1 Aug. 9, 2012

Related U.S. Application Data

(62) Division of application No. 11/583,420, filed on Oct. 18, 2006, now Pat. No. 8,161,592.

(51) Int. Cl.
*A46D 3/00* (2006.01)
*B29C 45/00* (2006.01)

(52) U.S. Cl.
USPC ..... 300/21; 264/241; 264/243

(58) Field of Classification Search
USPC ..... 300/21; 264/241, 243, 247
See application file for complete search history.

(56) References Cited

U.S. PATENT DOCUMENTS

| | | | |
|---|---|---|---|
| 2,039,565 | A | 5/1936 | Speik |
| 2,262,961 | A | 11/1941 | Otto |
| 2,948,014 | A | 8/1960 | Allen |
| 3,108,306 | A | 10/1963 | McWilliams |
| 3,111,699 | A | 11/1963 | Comeau |
| 3,524,210 | A | 8/1970 | McLean |
| 3,576,049 | A | 4/1971 | Williams |
| 4,087,880 | A | 5/1978 | Clark, Jr. |
| 4,528,713 | A | 7/1985 | Libman |
| 5,010,616 | A | 4/1991 | Berti |
| 5,485,648 | A | 1/1996 | Balducci et al. |
| 5,758,385 | A | 6/1998 | Waldner |
| 5,966,771 | A | 10/1999 | Stroud |
| 5,978,999 | A | 11/1999 | deBlois et al. |
| 6,108,852 | A | 8/2000 | Vrignaud |
| 6,108,854 | A | 8/2000 | Dingert |
| 6,151,747 | A | 11/2000 | Newman et al. |
| 6,298,516 | B1 | 10/2001 | Beals et al. |
| 6,408,474 | B1 | 6/2002 | Husted et al. |
| 6,591,457 | B1 | 7/2003 | Howie, Jr. |
| 6,598,257 | B2 | 7/2003 | Cavalheiro |
| 6,695,414 | B2 | 2/2004 | Meyer et al. |
| 6,698,057 | B2 | 3/2004 | Varga |
| 6,877,181 | B2 | 4/2005 | Laux et al. |
| 2003/0005533 | A1 | 1/2003 | Woodnorth et al. |
| 2005/0015905 | A1 | 1/2005 | Boyer et al. |
| 2005/0229348 | A1 | 10/2005 | Jones |
| 2005/0251941 | A1 | 11/2005 | Berhoff |

*Primary Examiner* — Randall Chin
(74) *Attorney, Agent, or Firm* — Leydig, Voit & Mayer, Ltd

(57) ABSTRACT

The broom may include a broom body. The broom body may include a shaft side, a shoulder disposed on the shaft side, a cleaning side, and a bump guard disposed on the shoulder. The broom may further comprise a shaft extending from the shoulder and a plurality of bristles extending from the cleaning side. The bump guard may be relatively softer than a main piece of the broom body. The broom body may also include a lower bump guard covering a toe and a heel of the broom body. In one embodiment, the broom body may be comprised of a core and a skin. The skin may be overmolded onto the core. The bump guard may be overmolded onto the skin. In another embodiment, the core and the skin may be molded together in a co-injection molding process.

29 Claims, 14 Drawing Sheets

CLEANING IMPLEMENT

CROSS-REFERENCE TO RELATED APPLICATIONS

This patent application is a divisional of U.S. patent application Ser. No. 11/583,420, filed Oct. 18, 2006, now U.S. Pat. No. 8,161,592, which is hereby incorporated by reference in its entirety as if set forth fully herein.

FIELD OF THE APPLICATION

The present invention relates generally to cleaning implements, and more particularly to brooms.

BACKGROUND

Brooms with plastic broom bodies have been used for many years. Typically these brooms have utilized molded broom bodies with relatively hard outer surfaces. These broom bodies have proved problematic in that the brooms may strike and damage furniture, walls, or other objects in a room as an operator sweeps. Typical brooms have proved particularly problematic when an operator tries to sweep under a piece of furniture with an overhang or under a piece of furniture supported on legs. As the operator sweeps under the furniture, the upper portions of the broom may strike the elevated pieces of the furniture, thereby damaging the furniture.

Common molded plastic broom bodies normally require expensive material and significant time to mold. Molded broom bodies have typically been injected molded as a single piece. A single piece requires substantial time to cool given the fact that the broom body is a solid piece of molded plastic. The time allotted for cooling tends to slow down the manufacturing process, especially when the broom bodies are left to cool in the mold. The single piece broom bodies are also expensive to produce because a manufacturer who wishes to use a particular desirable plastic to form the outside, visible part of the broom body needs to use the same desirable, and often expensive, plastic to form the entire broom body.

BRIEF SUMMARY

The broom may comprise a broom body which may include a shaft side, a shoulder disposed on the shaft side, a cleaning side, and a bump guard disposed on the shoulder. The broom may further comprise a shaft extending from the shoulder and a plurality of bristles extending from the cleaning side. The bump guard may be relatively softer than a main piece of the broom body. The broom body may also include a lower bump guard covering a toe and a heel of the broom body.

In another embodiment, there is provided a broom comprising a broom body, the broom body including a shaft side, a cleaning side, a core including recycled material, and a skin overmolded onto the core. The broom may further comprise a shaft extending from the shaft side at a shaft connector and a plurality of bristles extending from the cleaning side.

In another embodiment, the core may comprise a first piece and a second piece. The first piece and the second piece may be joined by a living hinge. The core may further include retention members, the retention members being capable of retaining the first piece and the second piece together. The core of the broom may be hollow.

In another embodiment, there is provided a broom comprising a co-injection molded broom body. The broom body includes a shaft side, a cleaning side, a core, and a skin at least partially surrounding the core. The skin and the core may be joined by co-injection molding. The broom further comprises a shaft extending from the shaft side and a plurality of bristles extending from the cleaning side.

In another embodiment, a method of producing a broom may comprise the steps of providing a core and overmolding a skin onto the core to create a broom body. The method may further comprise the steps of attaching bristles to the broom body and attaching a shaft to the broom body.

In another embodiment, a method of producing a broom may comprise the steps of producing a broom body in a co-injection molding process by injecting a skin material into a mold, the skin material flowing to the outside of the mold, and injecting a core material into the mold, the core material flowing to the inside of the mold. The method may further comprise the steps of attaching bristles to the broom body and attaching a shaft to the broom body.

BRIEF DESCRIPTION OF THE SEVERAL VIEWS OF THE DRAWING(S)

DETAILED DESCRIPTION OF THE EMBODIMENTS

Figure 1:
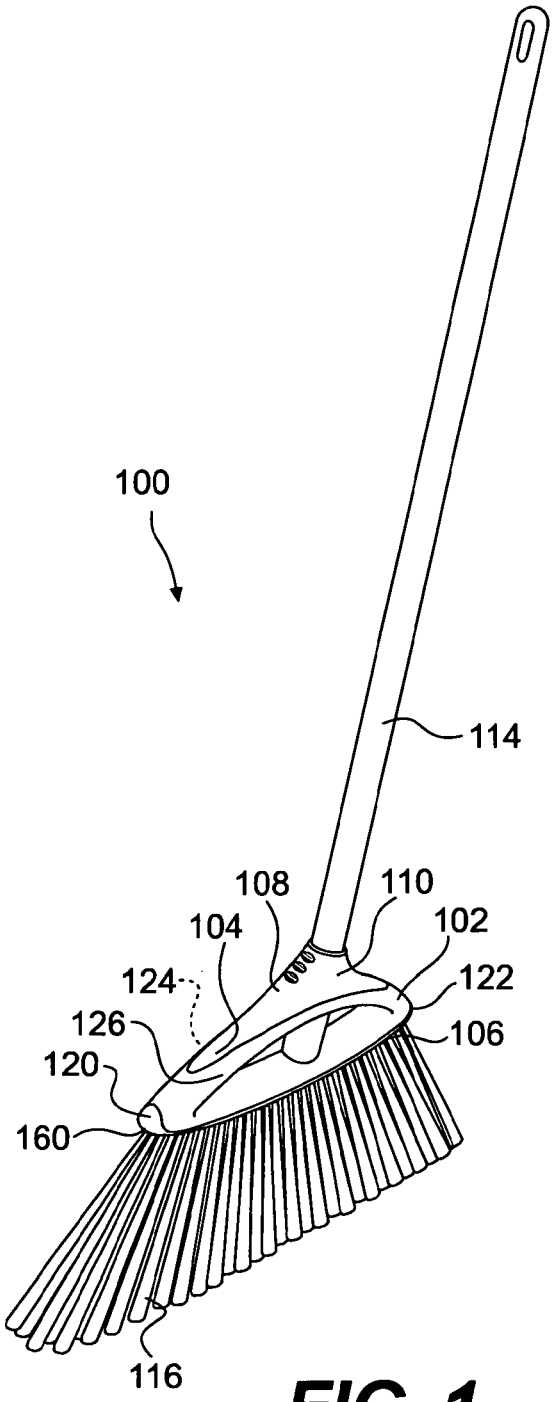
FIG. 1 is a perspective view of a broom.
Figure 2:
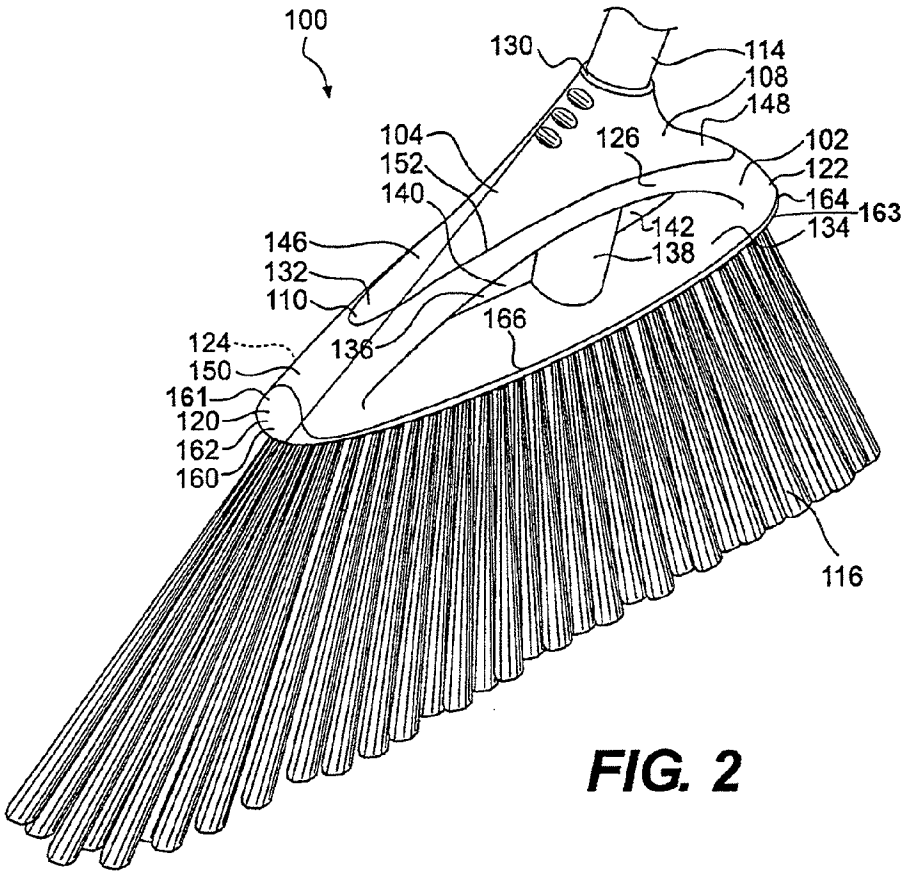
FIG. 2 is a partial perspective view of the broom of FIG. 1.
Figure 4:
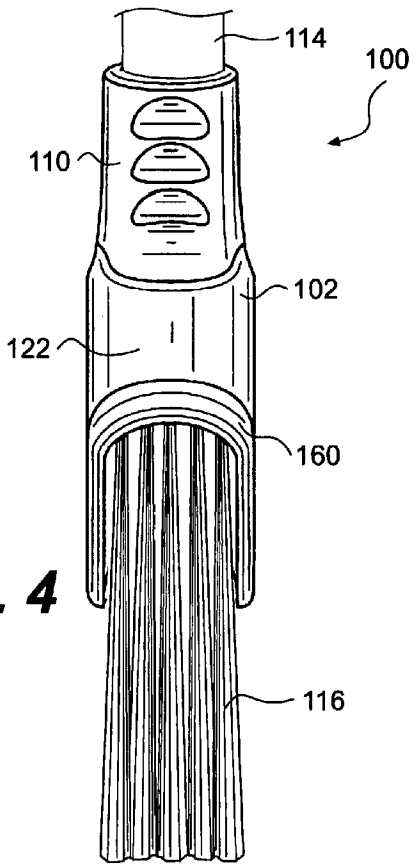
FIG. 4 is a partial rear view of the broom of FIG. 1.
Figure 3:
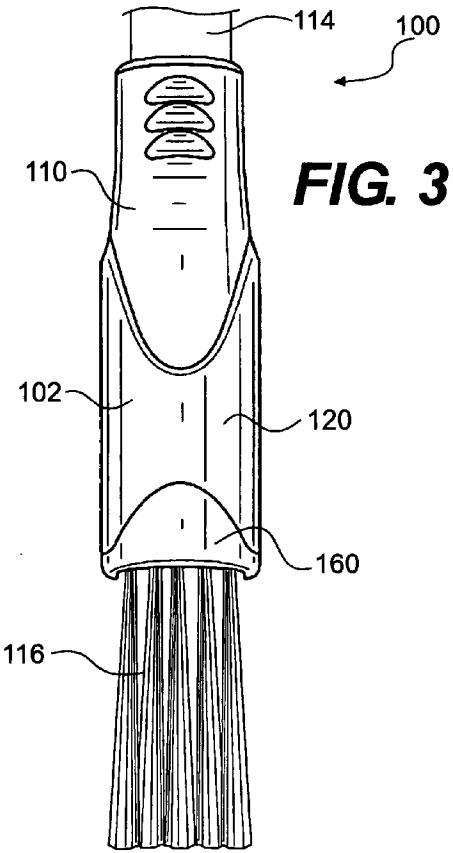
FIG. 3 is a partial front view of the broom of FIG. 1.

Referring to FIG. 1, a broom 100 may comprise a broom body 102. The broom body 102 may include a shaft side 104, a cleaning side 106, and a shoulder 108 disposed on the shaft side 104. The broom body 102 may include a bump guard 110 disposed on the shoulder 108. The broom may further comprise a shaft 114 extending from the shoulder 108 and a plurality of bristles 116 extending from the cleaning side 106. The broom body 102 may further comprise a front 120, a rear 122, a first face 124, and a second face 126. Referring to FIG. 2, the shaft 114 may be joined to the broom body 102 at a shaft connector 130. The broom body 102 may be comprised of an upper piece 132 and a lower piece 134 that define an interior vacancy 136. The broom body 102 may include a center piece 138 that connects the upper piece 132 and the lower piece 134 and divides the interior vacancy 136 into a front part 140 and a rear part 142.

The bump guard 110 may be located in various locations on the shaft side 104 and in various configurations. Referring to FIG. 2, in one embodiment, the bump guard 110 may be at least partially disposed on the shaft connector 130. The bump guard 110 may comprise a front section 146 disposed between the shaft 114 and the front 120. The bump guard 110 may also include a rear section 148 disposed between the shaft 114 and the rear 122. The bump guard 110 may cover parts of the shaft side 104, the shoulder 108, the first face 124, and the second face 126.

Referring to FIG. 2, the bump guard 110 may be relatively softer than a main piece 150 of the broom body 102. The bump guard 110 may be comprised of rubber, thermoplastic material, such as metalocene polyolefin, or any other material with a hardness which is lower than or similar to the material used for the main piece 150. The main piece 150 may be comprised of thermoplastic material, such as, polypropylene or polyethylene, with a hardness which is higher than or similar to the material used for the bump guard 110. The bump guard 110 may be overmolded onto the broom body 102. Accordingly, the bump guard 110 may be a single piece of material without any seams. The broom body 102 may include a channel 152 configured to receive the bump guard 110. The bump guard 110 may be disposed within the channel 152 so that the bump guard 110 is flush with the main piece 150 of the broom body 102. In other embodiments, the bump guard may be above or below the surface of the main piece. In other embodiments, the bump guard may be fitted onto the broom body in a non-molding process, such as, by adhesive, snap features, interlocking features, or by making use of an undercut.

Figure 5:
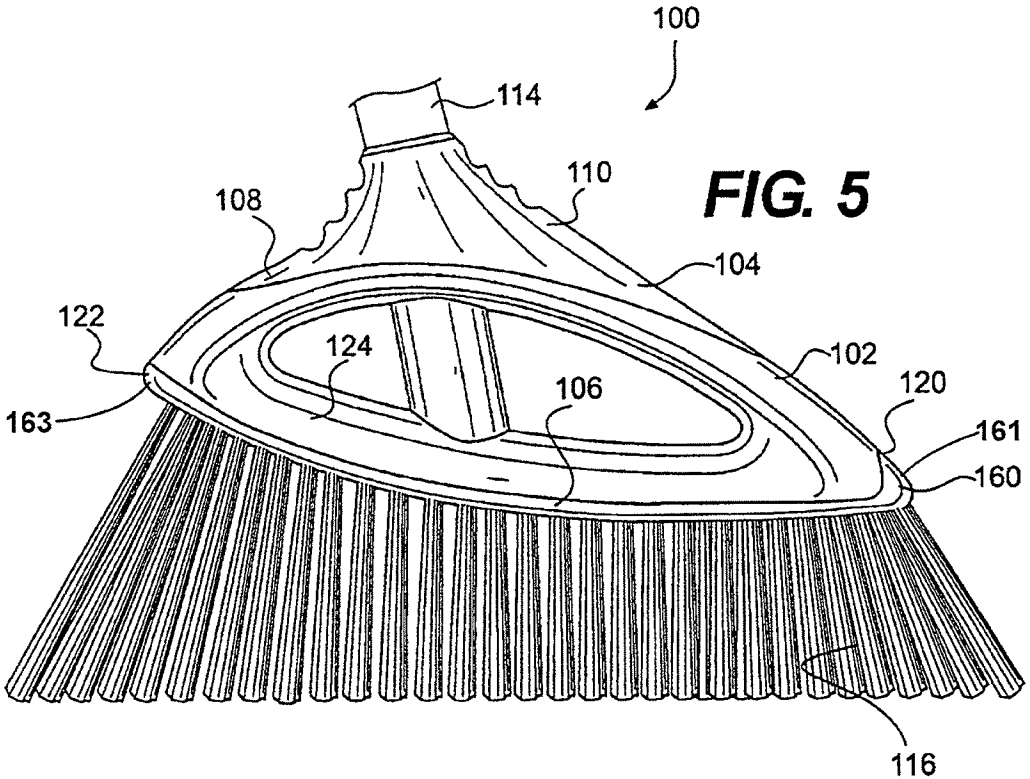
FIG. 5 is a partial side view of the broom of FIG. 1.
Figure 6:
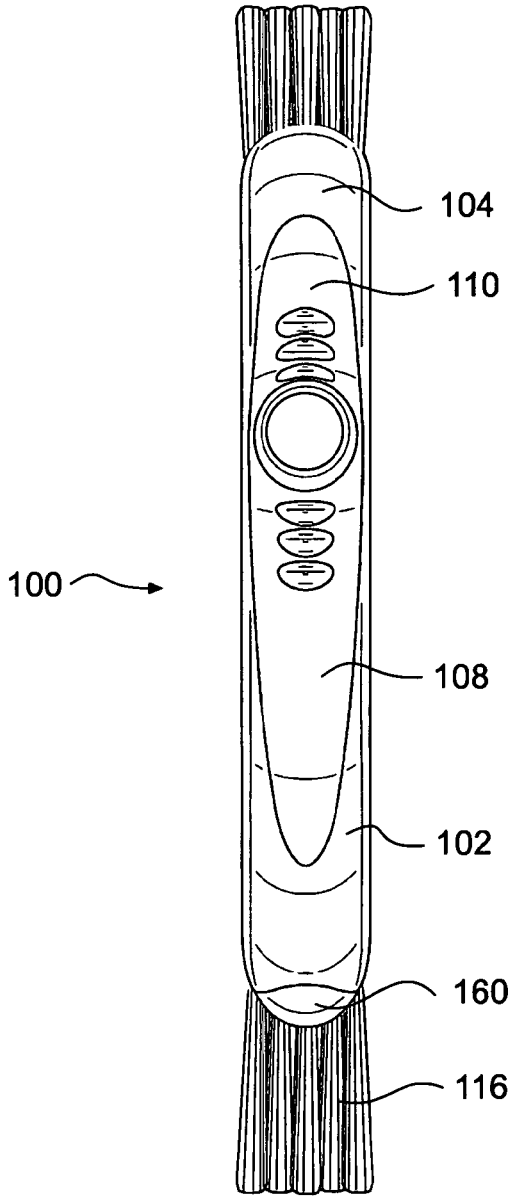
FIG. 6 is top view of the broom body of the broom of FIG. 1.

Referring to FIG. 2, the broom body 102 may include a lower bump guard 160. The lower bump guard may include a lower front bump guard 161 at a toe 162 of the broom body 110, which is located at the front 120. The lower bump guard 160 may include a rear lower bump guard 163 at the heel 164 of the broom body 102, which is located at the rear 122. The lower front bump guard 161 and the lower rear bump guard 163 may be one piece as shown in FIG. 5 or may be separate pieces. The lower bump guard 160 may be overmolded or fitted into a channel 166 of the broom body 102. The lower bump guard 160 may be similarly comprised as the bump guard 110.

Figure 7:
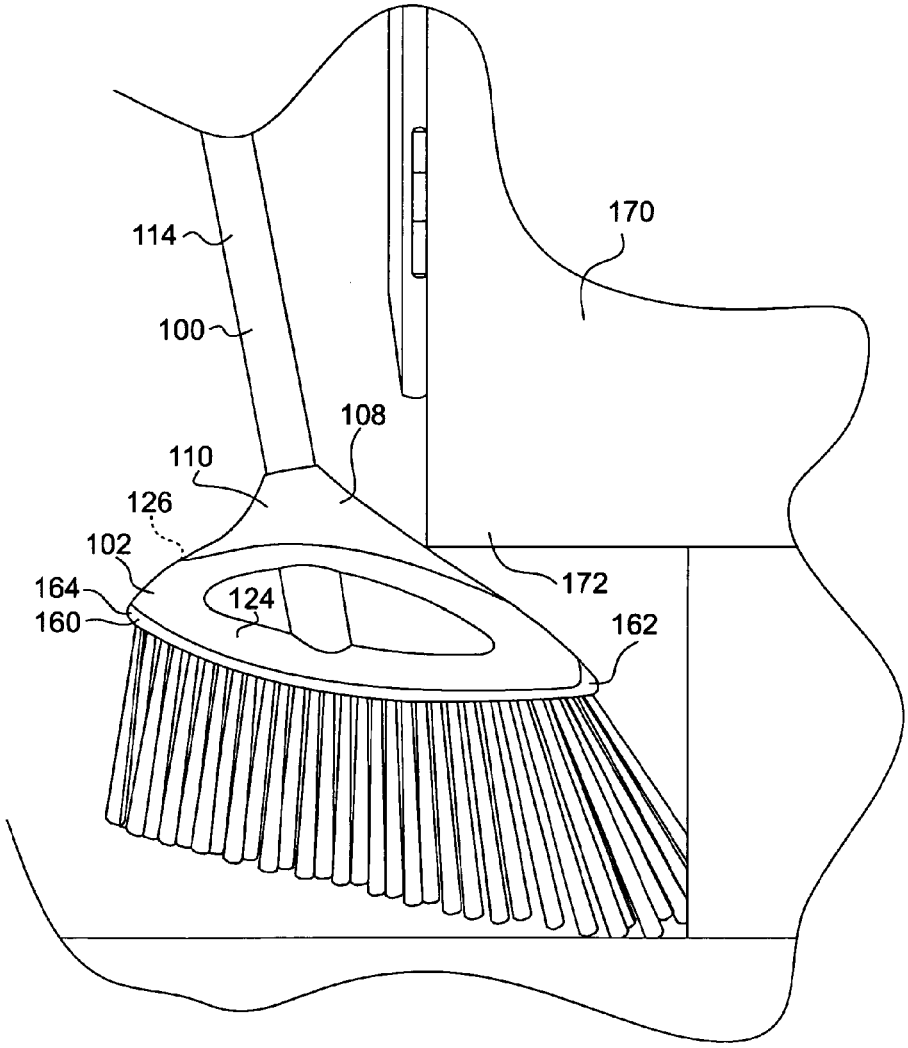
FIG. 7 is a view of the broom of FIG. 1 making contact with a piece of furniture.

Referring to FIG. 7, the location and the composition of the bump guard 110 may help to protect furniture 170 from damage from the broom 100 when the broom 100 is employed to sweep an area near the furniture 170. The bump guard 110 may be composed of a relatively soft, rubber material. The bump guard may not dent, scratch, or otherwise disfigure furniture 170 when the bump guard 110 makes contact with the furniture. The bump guard 110 may be particularly effective in protecting furniture 170 with an overhang 172 because the bump guard 110 is located on the shoulder 108 of the broom body 102. The location of the bump guard 110 permits an operator to more easily clean under a piece of furniture 170 and reduce the risk of damaging the furniture 170 through contact with the broom 100. The lower bump guard 160 may similarly protect furniture by protecting furniture that is contacted by the broom 100 at the heel 164, toe 162, or lower edges of the first and second faces 124, 126.

Figure 8:
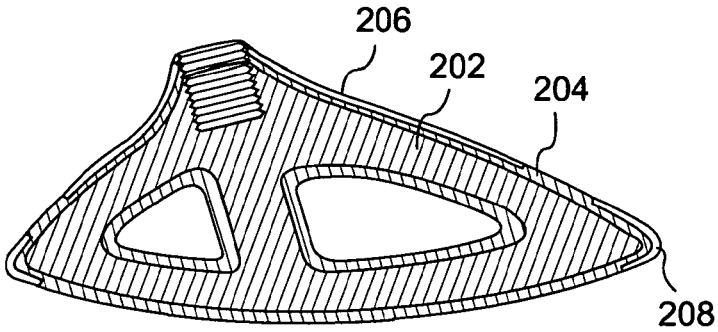
FIG. 8 is a cross sectional view of a broom body of another embodiment.

Referring to FIG. 8, in one embodiment, the broom body 200 may be comprised of several layers 202, 204, 206, 208. The broom body 200 may include a core 202 and a skin 204 overmolded onto the core 202. The broom body 200 may further include a bump guard 206 overmolded onto the skin 204. The broom body 200 may also include a lower bump guard 208 overmolded onto the skin 204. Referring to FIG. 8, the broom body 200 may include a core 202. The core 202 may include recycled material or may be comprised entirely of recycled material. The core 202 may be plastic such as polypropylene, polyethylene, polyethylenterephthalat, acrylnitril-butadien-styrol, any other thermoplastic material, or a mixture of any of these materials. The plastic may be virgin material or recycled material or any mixture of virgin and recycled materials. In one embodiment, the core 202 may include structural foam which has solidified to form a porous and lightweight plastic core 202. The core 202 may include a shaft connector 212 for receiving the shaft, wherein the shaft connector 212 may be threaded.

Figure 9:
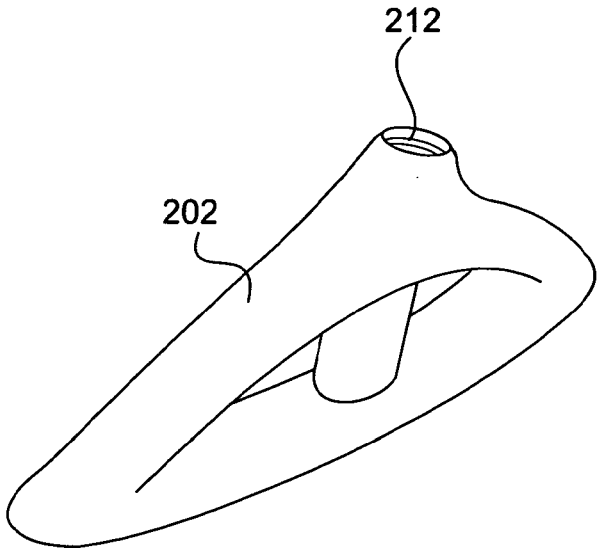
FIG. 9 is a perspective view of the core of FIG. 8.

Referring to FIG. 9, the skin 204 may be overmolded onto the core 202. In one embodiment, the core 202 may be entirely enclosed by the skin 204. In other embodiments, the skin may only partially enclose the core. The skin 204 may also be comprised of thermoplastic material, such as, polypropylene or polyethylene, with a hardness which is higher than or similar to the material used for the bump guard 206. In one embodiment, the skin 204 may be comprised of a denser or stronger material than the core 202. The skin 204 may also be comprised of plastic with a more aesthetically pleasing appearance which will be visible to the user. The skin 204 may be overmolded onto the core 202 such that skin includes a channel 214 that is configured to receive the bump guard. The skin 204 may include a lower channel 216 configured to receive the lower bump guard. In other embodiments, the channels may be created by the absence of the skin 204 on the core 202.

Figure 10:
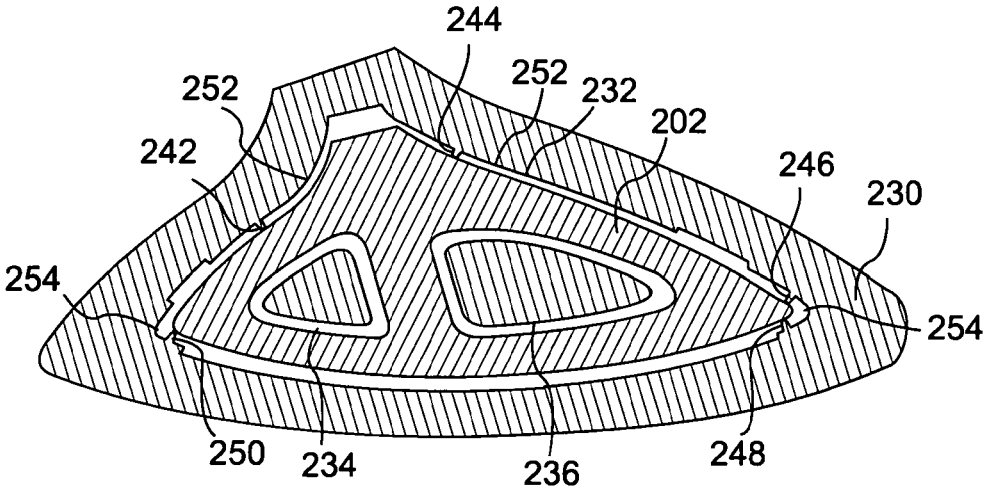
FIG. 10 is a cross sectional view of the core of FIG. 9 disposed within a mold.

Referring to FIG. 10, the skin may be overmolded onto the core 202 in mold 230. The mold 230 may be a component of or used in conjunction with an injection molding machine. The core 202 may be arranged in the mold 230 such that the gap between the core 202 and the inner walls 232, 234, 236 of the mold substantially defines the space around the core 202 that the skin will fill. The core 202 may be held in place in the mold 230 by pins 242, 244, 246, 248, and 250, which ensure that the gap is consistent with the desired skin thickness. The inner wall 232 of the mold may include projections 252, 254 that will define the channels in the skin for receiving the bump guards. The pins 242, 244, 246, 248 may be located on the projections 252, 254. Accordingly, any vacancies left in the skin by the pins 242, 244, 246, 248 will be located below the channels such that the vacancies may be filled or hidden when the bump guards are deposited over them into the channels. As the skin material is injected into the mold 230, it will fill the gap between the core and the mold. The core 202 and skin may be left in the mold 230 until the skin solidifies. Referring to FIG. 9, the core 202 with the overmolded skin 204 may then be removed from the mold. In one embodiment, the pins may be retractable, such that after the skin sufficiently solidifies to hold the core in position within the mold then the pins are retracted. In another embodiment, the projections may be retractable such that the same mold may be used to overmold the skin onto the core as well to overmold the bump guards onto the skin.

Figure 11:
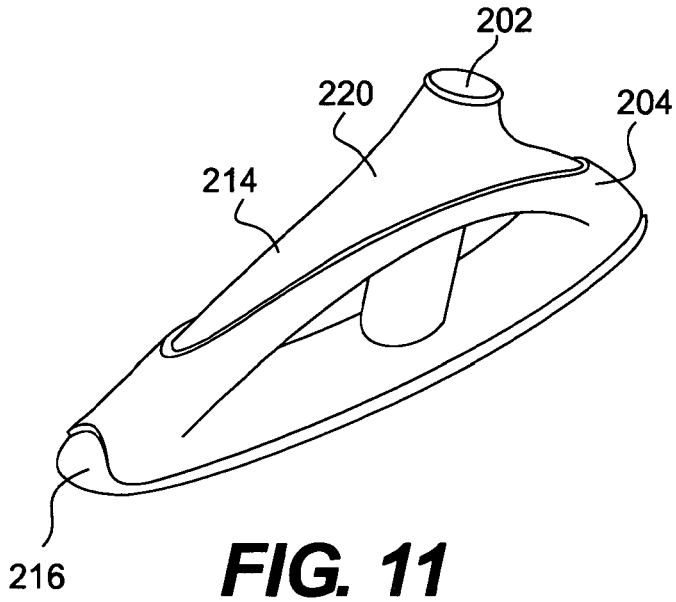
FIG. 11 is a perspective view of the core and the skin of the broom of FIG. 9.
Figure 12:
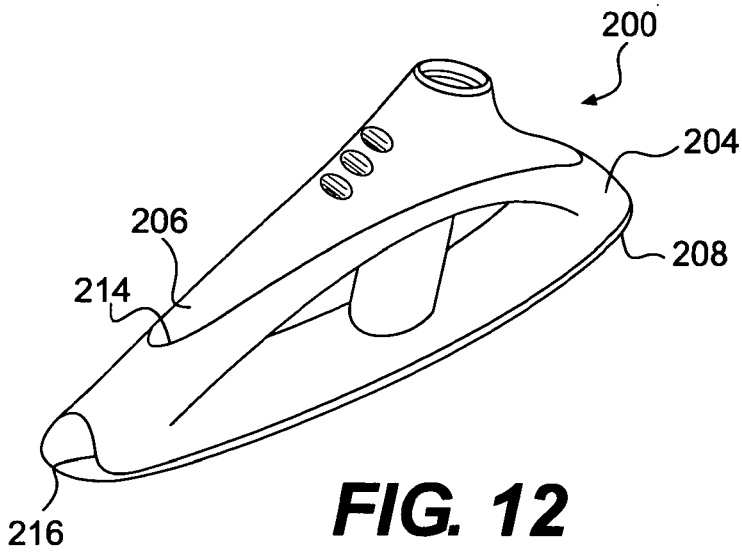
FIG. 12 is perspective view of the core, the skin, and the bump guard of the broom of FIG. 9.
Figure 13:
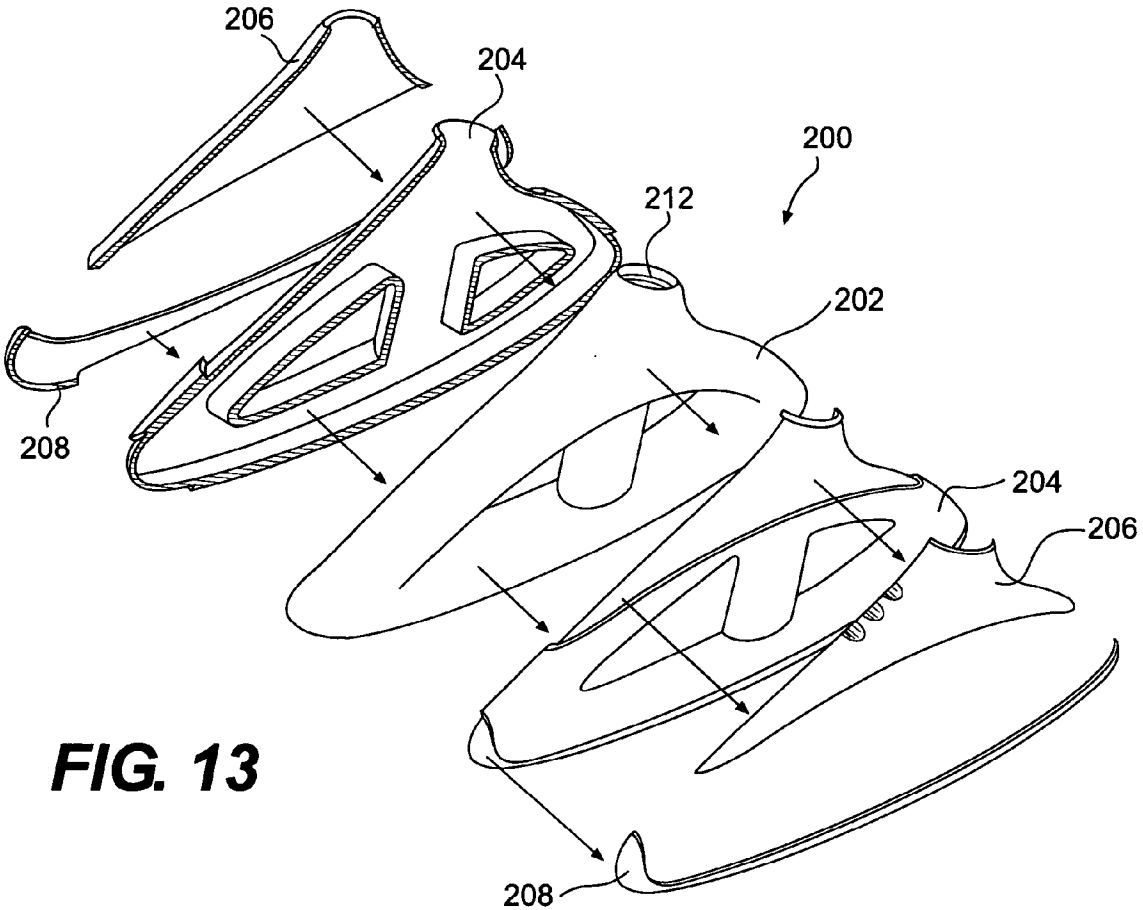
FIG. 13 is an exploded view of the broom body of FIG. 12.

Referring to FIGS. 11-13, the bump guard 206 may be overmolded onto the skin 204. The bump guard 206 may be disposed within the channel 214 so that the bump guard 206 is flush with the skin 204 of the broom body 200. The lower bump guard 208 may also be overmolded onto the skin 204. The lower bump guard 208 may be disposed within the lower channel 216 such that it is flush with the skin 204 of the broom body 200. The bump guards 206, 208 may be comprised of relatively softer material than the skin 204, such as, rubber, thermoplastic material, such as metalocene polyolefin, or any other material with a hardness which is lower than or similar to the material used for the skin 204. In other embodiments, the bump guards may be above or below the surface of the skin. Also, in other embodiments, if the channel is created by the absence of the skin, then the bump guard may be overmolded onto the core.

Referring to FIG. 11, the skin 204 may have a thickness 220 in the range of between 0.020 inches (0.0508 cm) to 1 inch (2.54 cm). In one embodiment, the skin 204 may have a thickness 220 of 0.1 inches (0.254 cm). The bump guard 206 may have a thickness 222 in the range of between 0.020 inches (0.0508 cm) to 1 inch (2.54 cm). In one embodiment, the bump guard 206 may have a thickness 222 of 0.10 inches (0.254 cm).

Referring to FIGS. 14-17, in another embodiment, the core 300 may be comprised of a first piece 302 and a second piece 304. The first piece 302 and the second piece 304 may each comprise approximately half of the core 300. The core 300 may be divided lengthwise from shaft side 306 to cleaning side 308. The first and second pieces 302, 304 may be joined by a living hinge 310. In other embodiments, the first and second pieces may be separate pieces. The shaft connector 312 may be divided between the first and second pieces 302, 304. In other embodiments, the shaft connector may not be divided and may be located on the first piece 302 or the second piece 304. The first piece 302 and the second piece 304 may include flat internal faces 316, 318 that may correspond to one another.

Figure 15:
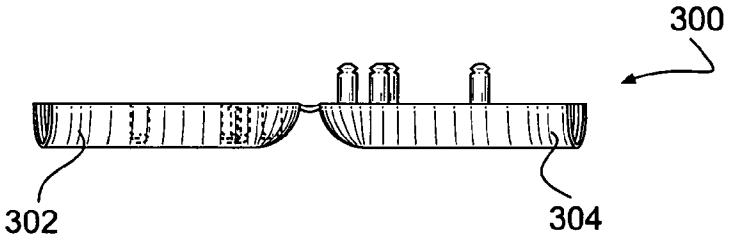
FIG. 15 is a rear view of the core of FIG. 14.
Figure 14:
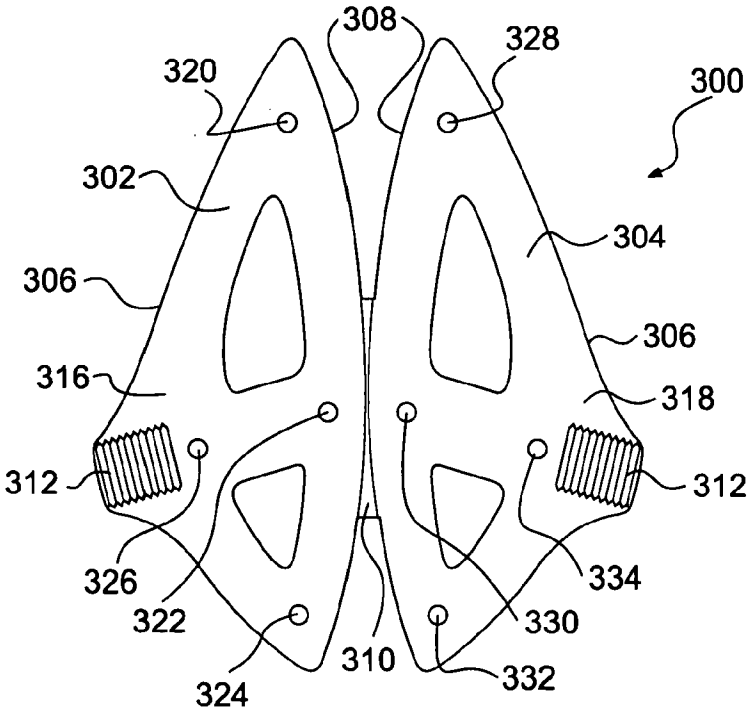
FIG. 14 is a top view of a core of another embodiment.
Figure 16:
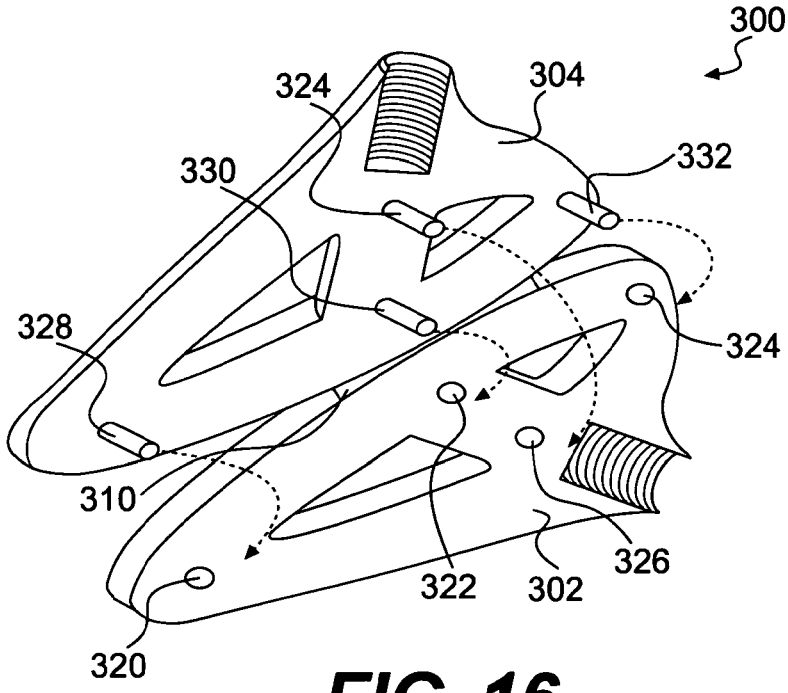
FIG. 16 is a perspective view of the core of FIG. 14.
Figure 17:
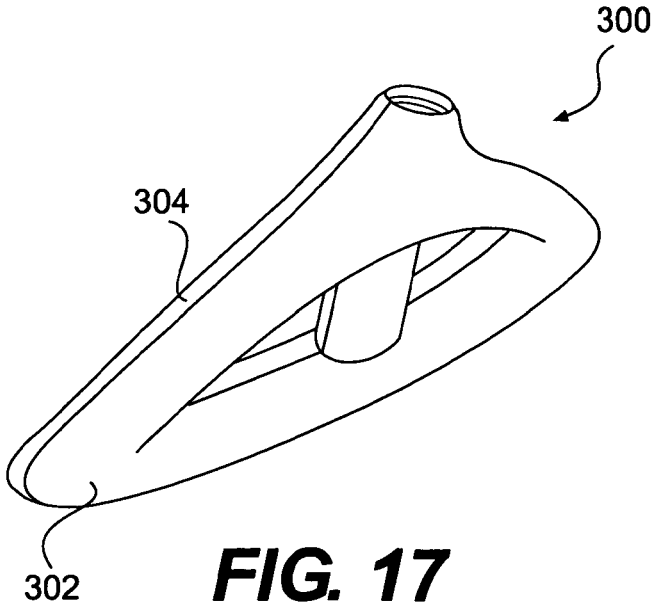
FIG. 17 is a perspective view of the core in FIG. 16 which has been assembled.

Referring to FIGS. 14-17, the core may include retention members 320, 322, 324, 326, 328, 330, 332, 334, wherein the retention members 320, 322, 324, 326, 328, 330, 332, 334 are capable of retaining the first piece 302 and the second piece 304 together. The retention members 320, 322, 324, 326, 328, 330, 332, 334 may be a post and socket configuration. Referring to FIG. 14, the first piece 302 may include sockets 320, 322, 324, 326 configured to receive a corresponding number of posts 328, 330, 332, 334 on the second piece 304. The first piece 302 and the second piece 304 may be folded together along the living hinge 310 until the internal face 316 of the first piece 302 meets the internal face 318 of the second piece 304, as shown in FIG. 15. The sockets 320, 322, 324, 326 may retain the posts 328, 330, 332, 334, thereby securing the first piece 302 to the second piece 304. The sockets and posts may be retained by a friction fit, ribs, or a snap-fit. After the core 300 is assembled, a skin may be overmolded onto the core to create the broom body. Bumper guards may then be overmolded onto the skin.

Figure 18:
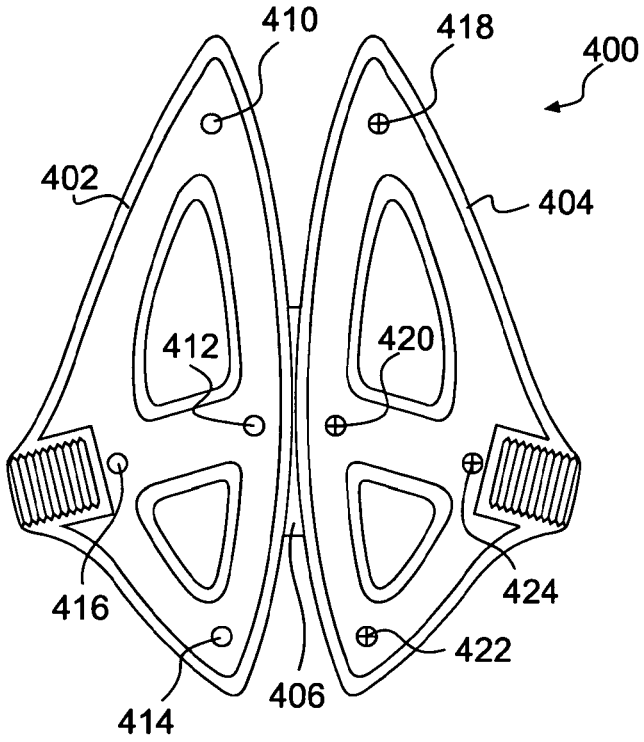
FIG. 18 is a top view of a core of another embodiment.
Figure 19:
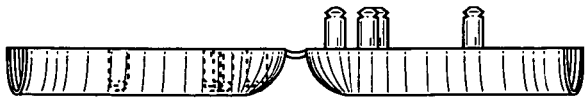
FIG. 19 is a rear view of the core of FIG. 18.
Figure 20:
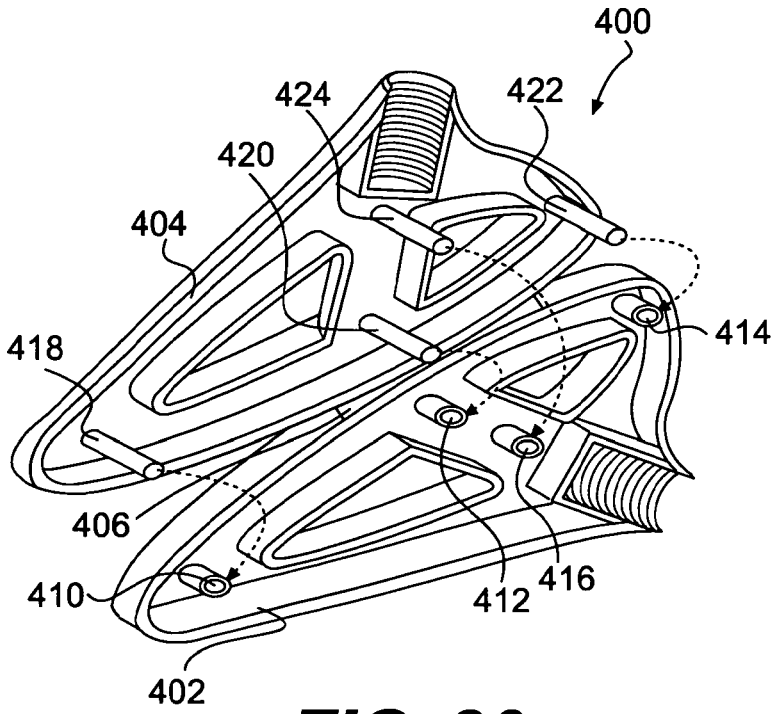
FIG. 20 is a perspective view of the core of FIG. 18.
Figure 21:
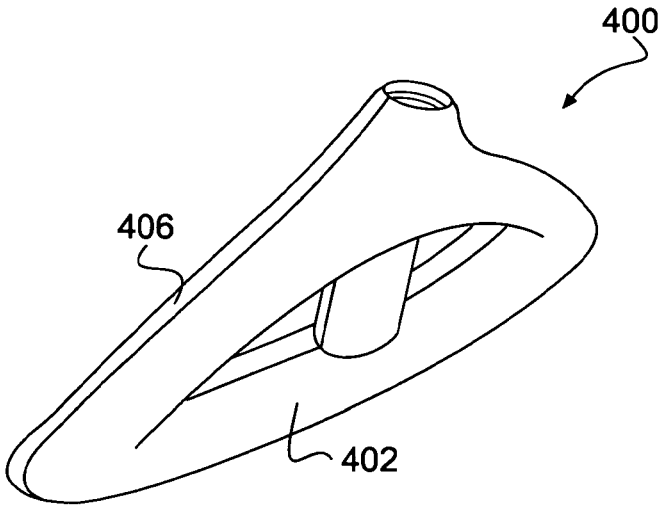
FIG. 21 is a perspective of the core in FIG. 18 which has been assembled.

Referring to FIGS. 18-21, in another embodiment, the core 400 may include a first piece 402 and a second piece 404. The first and second pieces 402, 404 may be connected by a living hinge 406. In other embodiments, the first and second pieces may be separate pieces. The first piece 402 and the second piece 404 may be hollow. The core 400 may include retention members 410, 412, 414, 416, 418, 420, 422, 424, wherein the retention members 410, 412, 414, 416, 418, 420, 422, 424 are capable of retaining the first piece 402 and the second piece 404 together. The retention members 410, 412, 414, 416, 418, 420, 422, 424 may be a post and socket configuration. Referring to FIG. 18, the first piece 402 may include sockets 410, 412, 414, 416 configured to receive a corresponding number of posts 418, 420, 422, 424 on the second piece 404. The first piece 402 and the second piece 404 may be folded together along the living hinge 406 until the first piece 402 meets the second piece 404, as shown in FIG. 19. The assembled core 400 will be hollow. The sockets 410, 412, 414, 416 may retain the posts 418, 420, 422, 424, thereby securing the first piece 402 to the second piece 404. The sockets and posts may be retained by a friction fit, ribs, or a snap-fit. After the core 400 is assembled, a skin may be overmolded onto the core to create the broom body. Bumper guards may then be overmolded onto the skin.

Referring to FIG. 1, the broom may be produced by a multi-step process. In one embodiment, the broom body may be produced in an overmolding process. First, a core may be provided. The core may be premolded in a molding machine, such as, for example, an injection molding machine. The core may be molded from recycled material that includes a blowing agent. Accordingly, the core may be comprised of structural foam. After cooling, the core may be removed from the mold. If the core includes a first piece and a second piece, the pieces may be molded at the same time with a living hinge connecting the pieces. The two pieces may then be folded together at the hinge such that the retention posts of the core and are received by the sockets of the core, thereby securing the pieces together.

The core may then be transferred to another molding machine, such as an injection molding machine, and the skin may be overmolded onto the core. The skin may be overmolded to include channels for receiving bump guards. In one embodiment, the skin may be overmolded onto the core within a mold with retractable mold parts. The retractable mold parts may be extended into the mold when the skin is being molded in order to form the channels for receiving the bump guards. After the skin is overmolded onto the core, the retractable mold parts may be retracted, thereby leaving cavities defined by the channels and the mold. After the skin is overmolded onto the core, the core and the skin may be transferred to another molding machine, such as an injection molding machine. In one embodiment, the core and the skin may be transferred within the mold by a handling system. In another embodiment, the core and the skin may be transferred within the mold by an index plate of the molding machine, the index plate configured to rotate the mold part between molding stations. The bump guard and the lower bump guard may be overmolded onto the skin or onto the core such that the bump guards are deposited into their respective channels. In one embodiment, the bump guards may be deposited into the cavities created by the channels and the mold of a mold with retractable mold parts. In other embodiments, the bump guards may be fitted onto the broom body in a non-molding process.

Referring to FIG. 1, the bristles and the shaft may then be attached to the broom body to create the broom.

The overmolding process allows for a shortened manufacturing time per broom body and increases the output of individual molding machines. This is due to the fact that the broom bodies are produced in layers instead of as a single piece. The collective cooling time of the two to three molded layers of the overmolded broom is shorter than the cooling time associated with a similar broom body molded as a single piece. The vacancies of the broom body further reduce the cooling time of the molds. Additionally, the core material may be a relatively less dense material that cools faster than other plastics used in broom bodies. If the core is hollow, the cooling time is further decreased. Given the shortened cooling times of the molded pieces, the pieces may be removed from the molds quicker. This allows the molding machines to produce more parts in a given period of time, thereby increasing the output of a manufacturing line. In addition, the core material may be less expensive than the skin material and thus, the broom body is less expensive than a broom body made completely from the skin material.

The overmolding process also allows for a better molded part. The combination of a molded core covered by an overmolded skin allows for less sink on the skin because the overmolding process produces a more uniform thickness for the skin. The overmolded skin may also help produce a better molded part by compensating for areas of sink in the core.

In another embodiment, the core and the skin may be molded in the same molding machine in a co-injection molding process. The broom body may be produced by injecting skin material and core material into a mold from a single barrel of a molding machine in a single step. The skin material may flow to the outside of the mold while the core material may flow to the inside of the mold. The core material may help push the skin material to the sidewalls of the mold. The finished broom body will have a core comprised of the core material and a skin comprised of the skin material. The core material may be recycled material and may include a blowing agent. The molded core may be structural foam. The bump guards may be overmolded onto the skin layer in another molding machine. In one embodiment of the co-injection molding process, the broom body may be produced by a twinshot injection molding process. The core material and the skin material may be located in the same barrel of an injection molding machine before the molding process begins. The barrel of the molding machine may include a single screw. In one embodiment of the twinshot injection molding process, the skin material and the core material may be injected into the mold in a single step. The skin material may be located in front of the core material within the barrel. As the barrel discharges into the mold, the skin material may be injected first, followed by the core material. As the skin material enters, the skin material may attach to the sidewalls of the mold. The skin material may leave a vacancy in the interior of the mold. The skin material and the core material may enter the mold in a laminar flow wherein the core material follows the skin material into the mold. The core material may flow to the interior of the mold wherein it will be surrounded by the skin material. The core material may enter the vacancy left by the skin material. The core material may help push the skin material to the sidewalls of the mold as the core material enters the mold. The core material and the skin material may not mix such that they are deposited and solidify into distinct layers representing the skin and the core. In another embodiment of the co-injection molding process, the broom body may be produced by a sandwich injection molding process. In one embodiment of the sandwich injection molding process, the skin material and the core material may be injected into the mold in a single step similar to the twinshot injection molding process. The skin material and the core material may be located a single barrel of the injection molding machine. The core material may be sandwiched between skin material within the barrel. The majority of the skin material, a front portion, may be located in the front of barrel, followed by the core material, followed by the remainder of the skin material. The front portion of the skin material and the core material may enter the mold similar to the twinshot injection molding process. The remainder of the skin material may follow the core material into the mold. The remainder of the core material may fill the area of the mold where the core material entered the mold, thereby backfilling the core material's path of flow from the exterior of the mold. The core material may thereby be encapsulated within the skin material with no portion of core material extending to the exterior of the mold.

Referring to FIG. 1, the bristles and the shaft may then be attached to the broom body to create the broom.

The co-injection molding process allows for a shortened manufacturing time per broom body and increases the output of individual molding machines. This is due to the fact that the core material used may be chosen to have a lesser density or a faster cooling time than the skin material. Accordingly, the broom body will cool faster than a broom body molded entirely of the skin material. This allows the molding machines to produce more molded broom bodies in a given period of time, thereby increasing the output of a manufacturing line. The vacancies of the broom body further reduce the cooling time of the broom body mold. In addition, the core material may be less expensive than the skin material and thus, the broom body is less expensive than a broom body made completely from the skin material.

The novel improvements of the embodiments described herein are not solely suited for use with brooms. The features of the earlier described embodiments may be utilized in implements other than brooms to create yet further embodiments. Accordingly, the bump guard features, the overmolded construction, or the co-injection construction may be used with other cleaning implements, such as, for example, brushes, mops, or dusters. Additionally, many of the earlier described embodiments may be combined with each other to create further embodiments of the broom. Accordingly, all of the features discussed in the earlier described embodiments may be included in any of the other embodiments disclosed herein, as appropriate.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of producing a broom, the steps comprising:
a) providing a core; and
b) overmolding a skin onto the core to create a broom body, wherein the core includes recycled material.

2. The method of claim 1 further comprising the step of attaching bristles to the broom body.

3. The method of claim 1 further comprising the step of attaching a shaft to the broom body.

4. The method of claim 1 wherein the core includes foam.

5. The method of claim 1 wherein the core is premolded with a blowing agent.

6. The method of claim 1 wherein the skin is overmolded onto the core in a mold wherein the core is held in place within the mold by pins.

7. The method of claim 1 wherein the broom body includes a shaft side corresponding to the shaft and a cleaning side corresponding to the bristles, further comprising attaching a bump guard to the shaft side of the broom body.

8. A method for producing a broom, the steps comprising;
a) producing a broom body in a co-injection molding process by
i) injecting a skin material into a mold, the skin material flowing to the outside of the mold, and
ii) injecting a core material into the mold, the core material flowing to the inside of the mold.

9. The method of claim 8 further comprising the step of attaching bristles to the broom body.

10. The method of claim 8 further comprising the step of attaching a shaft to the broom body.

11. The method of claim 8 wherein the core material and the skin material are injected into the mold in a twinshot injection molding process, wherein the skin material and the core material are injected into the mold in a single step from a single barrel, the skin material being located in front of the core material within the barrel.

12. The method of claim 8 wherein the core material and the skin material are injected into the mold in a sandwich injection molding process, wherein the skin material and the core material are injected into the mold in a single step from a single barrel, the core material being sandwiched between skin material within the barrel.

13. The method of claim 12 wherein a remainder of the skin material may follow the core material into the mold, wherein the remainder of the core material may fill the area of the mold where the core material entered the mold, thereby backfilling the core material's path of flow from the exterior of the mold, the core material extending to the exterior of the mold.

14. The method of claim 8 wherein as the core material is injected it helps to push the skin material to the sidewalls of the mold.

15. The method of claim 8 wherein the skin material and the core material enter the mold in a laminar flow, wherein the core material and the skin material may not mix such that they are deposited and solidify into distinct layers representing the skin and the core.

16. A method of producing a broom, the steps comprising:
a) providing a core; and
b) overmolding a skin onto the core to create a broom body, wherein the core is premolded with a blowing agent.

17. The method of claim 16 further comprising the step of attaching bristles to the broom body.

18. The method of claim 16 further comprising the step of attaching a shaft to the broom body.

19. The method of claim 16 wherein the core includes recycled material.

20. The method of claim 16 wherein the core includes foam.

21. The method of claim 16 wherein the skin is overmolded onto the core in a mold wherein the core is held in place within the mold by pins.

22. The method of claim 16 wherein the broom body includes a shaft side corresponding to the shaft and a cleaning side corresponding to the bristles, further comprising attaching a bump guard to the shaft side of the broom body.

23. A method of producing a broom, the steps comprising:
a) providing a core; and
b) overmolding a skin onto the core to create a broom body, wherein the core includes foam.

24. The method of claim 23 further comprising the step of attaching bristles to the broom body.

25. The method of claim 23 further comprising the step of attaching a shaft to the broom body.

26. The method of claim 23 wherein the core includes recycled material.

27. The method of claim 23 wherein the core is premolded with a blowing agent.

28. The method of claim 23 wherein the skin is overmolded onto the core in a mold wherein the core is held in place within the mold by pins.

29. The method of claim 23 wherein the broom body includes a shaft side corresponding to the shaft and a cleaning side corresponding to the bristles, further comprising attaching a bump guard to the shaft side of the broom body.

* * * * *